US007324764B2

(12) United States Patent
Sakamoto

(10) Patent No.: US 7,324,764 B2
(45) Date of Patent: Jan. 29, 2008

(54) IMAGE FORMING APPARATUS

(75) Inventor: Takashi Sakamoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 44 days.

(21) Appl. No.: 11/252,875

(22) Filed: Oct. 19, 2005

(65) Prior Publication Data

US 2006/0204256 A1 Sep. 14, 2006

(30) Foreign Application Priority Data

Mar. 11, 2005 (JP) ..... 2005-069863

(51) Int. Cl.
*G03G 21/00* (2006.01)

(52) U.S. Cl. ..... 399/27; 399/359

(58) Field of Classification Search ..... 399/27, 399/359

See application file for complete search history.

(56) References Cited

U.S. PATENT DOCUMENTS

| | | | | |
|---|---|---|---|---|
| 6,879,785 | B2 * | 4/2005 | Ito et al. | 399/24 |
| 6,879,787 | B2 * | 4/2005 | Iino | 399/29 |
| 6,999,689 | B2 * | 2/2006 | Kinoshita et al. | 399/27 |
| 2005/0254839 | A1 * | 11/2005 | Nagamine et al. | 399/12 |

FOREIGN PATENT DOCUMENTS

| | | |
|---|---|---|
| JP | A-1-35579 | 2/1989 |
| JP | A-2000-131933 | 5/2000 |

* cited by examiner

*Primary Examiner*—David M. Gray
*Assistant Examiner*—Ruth N. LaBombard
(74) *Attorney, Agent, or Firm*—Morgan, Lewis & Bockius LLP

(57) ABSTRACT

An image forming apparatus includes a developing device that develops an electrostatic latent image formed on an image carrier with a toner, and a toner cartridge that replenishes the developing device with the toner. Excess toner on the image carrier is collected in the developing device for reuse, and image density is adjusted according to the number of times the toner cartridge is replaced.

20 Claims, 5 Drawing Sheets

IMAGE FORMING APPARATUS

BACKGROUND OF THE INVENTION

1. Field of the Invention

The present invention relates to an image forming apparatus, and more particularly to an image forming apparatus that forms an image by developing an electrostatic latent image formed on an image carrier with a toner.

2. Description of the Related Art

An image forming apparatus, such as a dry copying machine, frequently uses a developing device that develops an electrostatic latent image on a photosensitive drum by using a two-component developer made up of toner and a carrier. In such an image forming apparatus, the toner density (the ratio of the toner to the carrier) of the two-component developer is detected with a toner density sensor for detecting the toner density of the developer within the developing device. Toner density may be controlled by replenishing the toner on the basis of the detected ratio, thereby keeping the toner density constant.

The assembly in which the toner and carrier are mixed and stirred and the image on the photosensitive drum surface is developed is often provided as an assembled unit replaceable by the end user or a service engineer because of its high susceptibility to wear. The toner to be consumed is also modularized into a toner cartridge readily replaceable by the end user. Since the toner cartridge predictably runs out of toner during the life cycle of the developing device, the toner cartridge is typically replaced a number of times during the service life of the developing device.

When residual toner collected in the cleaning process of the photosensitive drum is returned into the developing device for reuse, the toner collected inevitably includes paper dust contaminants, which end up in the developing device. If the quantity of the collected toner and paper dust in the developing device increases beyond a prescribed level, it will affect the electric charge and toner grain size distribution in the developer within the developing device. Eventually, this will invite problems such as intensified fogging of the background due to a low charge and smearing caused by scattered toner.

The quantity of toner collected in the developing device is correlated to the amount of toner supplied from the toner cartridge. The more frequently the toner cartridge is replaced, the higher the proportion of toner collected in the developing device, leading to the problems noted above.

In an apparatus that detects the amount of toner remaining in the toner cartridge using a toner density detecting sensor, the emptiness of the toner cartridge is detected from a drop in toner density within the developing device. In such a case, a temporary drop in toner density within the developing device at the time the amount of toner remaining in the toner cartridge is detected invites deterioration of the developer within the developing device. After the next toner cartridge replacement, if the output level of the toner detecting sensor is controlled to the control target value, the deterioration of the developer will raise the toner density, eventually leading to a problem of an increased density of the output image.

Regarding this problem, an apparatus equipped with a density sensor that directly measures the density of the toner on the photosensitive drum could control the toner density to prevent the output image from becoming too dense. However, in an apparatus having no such density sensor, a rise in toner density would also make the output image too dense, resulting in an increase in toner consumption and, accordingly, a rise in cost.

Thus, as shown in FIGS. 5A, 5B and 5C, even though the replacement of the toner cartridge is repeated, if an increasing number of sheets are printed with the target control value of the toner density detecting sensor kept fixed as the toner density (FIG. 5A), the quantity of collected toner and paper dust will increase with the number of sheets printed. Further, after the replacement of a toner cartridge having run out of toner, the toner density that has temporarily fallen is recovered to the control target value under the control of the toner detecting sensor (FIG. 5B), but the deterioration of the developer due to the toner density drop will eventually lead to a denser image as shown in FIG. 5C.

This problem naturally compounds as the toner cartridge replacement is repeated. The resulting undesirable increase in image density may intensify with the frequency of toner cartridge replacements.

To address this problem, it has been proposed to provide toner cartridges in which the characteristics of the toner contained in the toner cartridges is different from one cartridge to another, so that the replacement of the toner cartridge may not result in an increased image density. However, this arrangement requires installation of plural toner cartridges in a single apparatus, which may lead to confusion on the user's part or a rise in the manufacturing and storage costs of the toner and toner cartridges.

SUMMARY OF THE INVENTION

An image forming apparatus is provided. The image forming apparatus includes a developing device for developing an electrostatic latent image formed on an image carrier with a toner, and a toner cartridge for replenishing the developing device with the toner, wherein the toner on the image carrier is collected into the developing device for reuse, and image density is adjusted according to the number of times the toner cartridge is replaced.

BRIEF DESCRIPTION OF THE DRAWINGS

Embodiments of the present invention will be described in detail based on the following drawings, which, together with the general description given above and the detailed description given below, serve to explain features of the invention.

DETAILED DESCRIPTION OF THE INVENTION

<Hardware Configuration>

Figure 1:
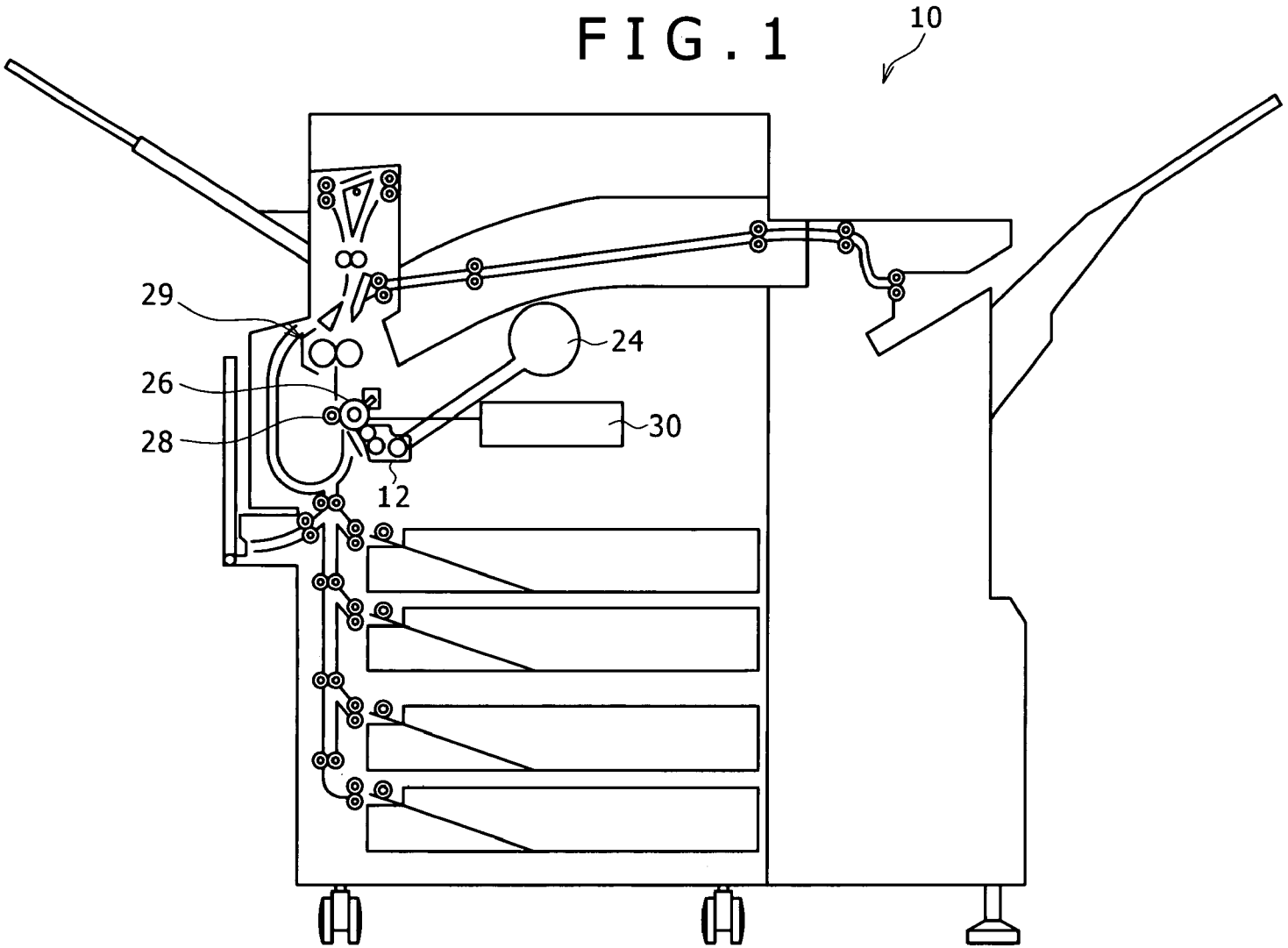
FIG. 1 shows the configuration of an image forming apparatus according to an embodiment of the present invention.

FIG. 1 shows the configuration of an image forming apparatus according to an embodiment of the present invention.

As shown in FIG. 1, an image forming apparatus 10 is an electrophotographic image forming apparatus equipped with a developing device that, after electrically charging the surface of a photosensitive drum with a charger, forms an electrostatic latent image by irradiating the surface with a laser beam, and develops this electrostatic latent image with a two-component developer containing toner and a carrier.

More specifically, the image forming apparatus 10 includes an image writing device 30 that forms a latent image by writing image data, delivered from a PC or the like (not shown), onto the pre-charged surface of a photosensitive drum 26 with a laser beam or the like, a developing device 12 that transfers toner to the latent image on the photosensitive drum 26 and develops it as a toner image, a transfer roller 28 that presses a paper sheet against the photosensitive drum 26 to transfer the toner image on the photosensitive drum 26 to the paper sheet, and a fixer 29 that fixes the toner image transferred onto the paper sheet by applying heat and pressure.

Figure 2:
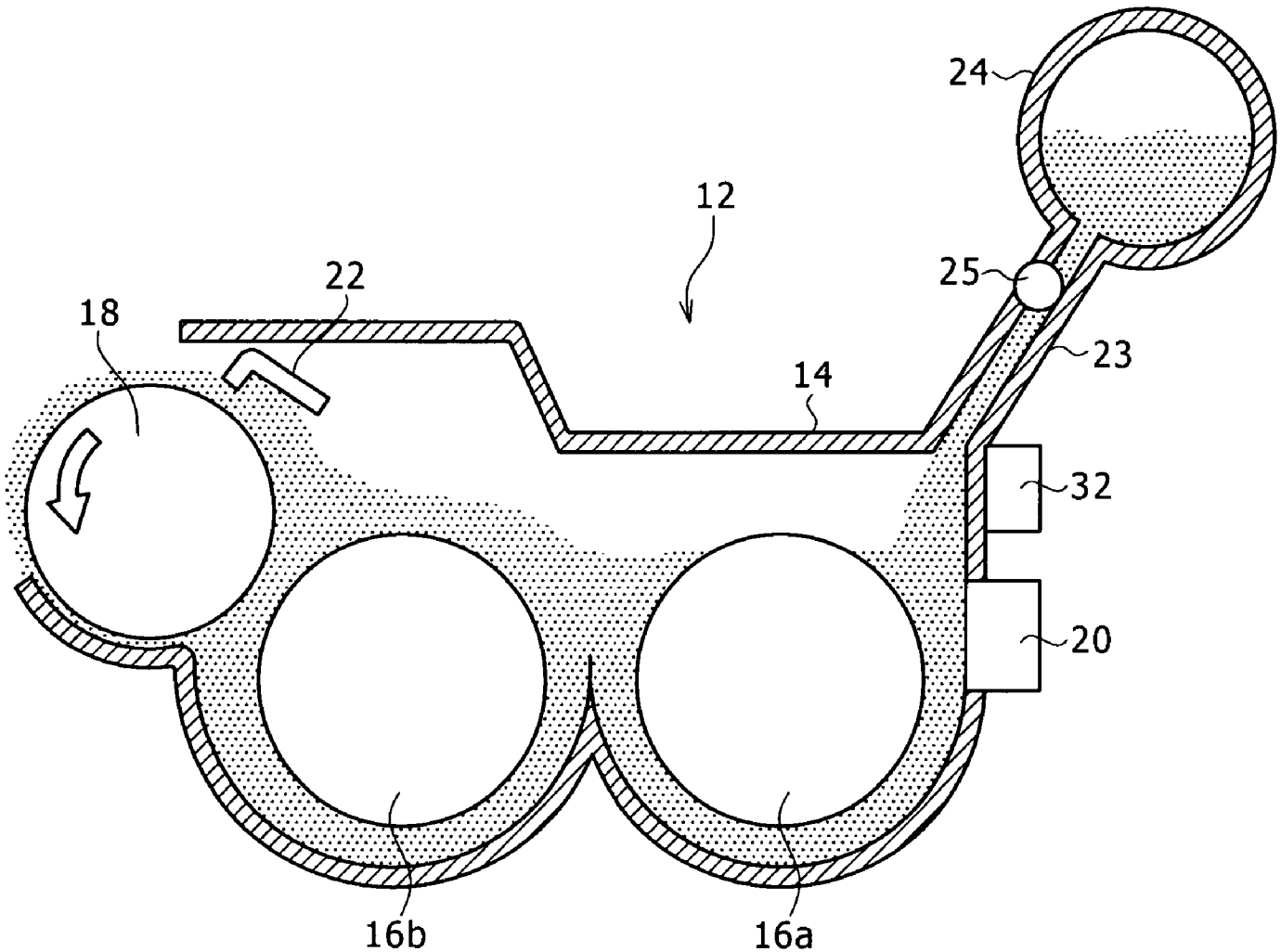
FIG. 2 shows the configuration of a developing device according to an embodiment of the present invention.

As illustrated in FIG. 2, the developing device 12 is provided with a developer regulating member 22 for regulating the quantity of toner to be supplied by a developing roller 18 to the photosensitive drum 26. A toner cartridge 24 is connected to the developing device 12 via a pipe 23. The quantity of toner supplied from the toner cartridge 24 to the developing device 12 is adjusted with the duration of the rotation of a dispense motor 25.

Further, the developing device 12 is provided with a toner density detecting sensor 20 for measuring the toner density in the developer within the developing device 12. This sensor, which in an embodiment is a magnetic permeability sensor, measures the toner density of the developer within the developing device 12, namely the toner-carrier mixture, to keep the toner density in the developer substantially constant. Of course, as would be recognized by those of skill in the art, other types of toner density sensors may be used and are included within the scope of the present invention.

The residual toner not transferred to the paper sheet but remaining on the surface of the photosensitive drum 26 after the transfer is cleaned with a cleaner (not shown). The untransferred residual toner collected at the cleaning step can be carried into the developing device 12 for its effective reuse.

Since the developing device 12 and photosensitive drum 26 are less durable than the image forming apparatus 10, they are typically available as assembled units for replacement. For instance, the developing device 12 and the photosensitive drum 26 are integrated into replacement units to be periodically replaced by the user or a service engineer to maintain the required performance level.

Also, as the quantity of toner that can be replenished by the toner cartridge 24 is usually set to last less than the useful life of the developing device 12, the end user is expected to replace the toner cartridge 24 plural times as a separate unit.

Referring again to FIG. 2, the developing device 12 is further provided with a developer tank 14 for accommodating the developer, the developing roller 18 and two spiral augers 16*a* and 16*b*. The toner is supplied from the toner cartridge 24 to the developing device 12 as described above, and the supplied quantity of the toner is adjusted with the duration of the rotation of the dispense motor 25. The developing roller 18 is disposed adjacent to the photosensitive drum 26, and turns around its axis to supply the toner adsorbed by the carrier in the developer within the developer tank 14 to the photosensitive drum 26. The electrostatic latent image thereby formed on the photosensitive drum 26 is developed to form a toner image. The two augers 16*a* and 16*b* carry the developer within the developer tank 14 toward the developing roller 18 while stirring the developer. The developing roller 18 is provided with the developer regulating member 22 to regulate the quantity of the developer on the surface to a constant thickness.

On the other side of the developer tank 14, there is disposed the toner density detecting sensor 20 capable of detecting the permeability of the developer within the developer tank 14. The toner density detecting sensor 20 detects the toner density of the developer at regular intervals of time, and supplies as the result of detection a signal, such as a voltage, corresponding to the toner density to a toner density controller 36 (shown in FIG. 3).

The developing device 12 is provided with a toner cartridge replacement detector 32 to detect the replacement of the toner cartridge 24. Toner cartridge replacement detector 32 stores the number of times the cartridge is engaged or disengaged, and inputs the number to a controller 34 (shown in FIG. 3).

<Image Density Control>

Figure 3:
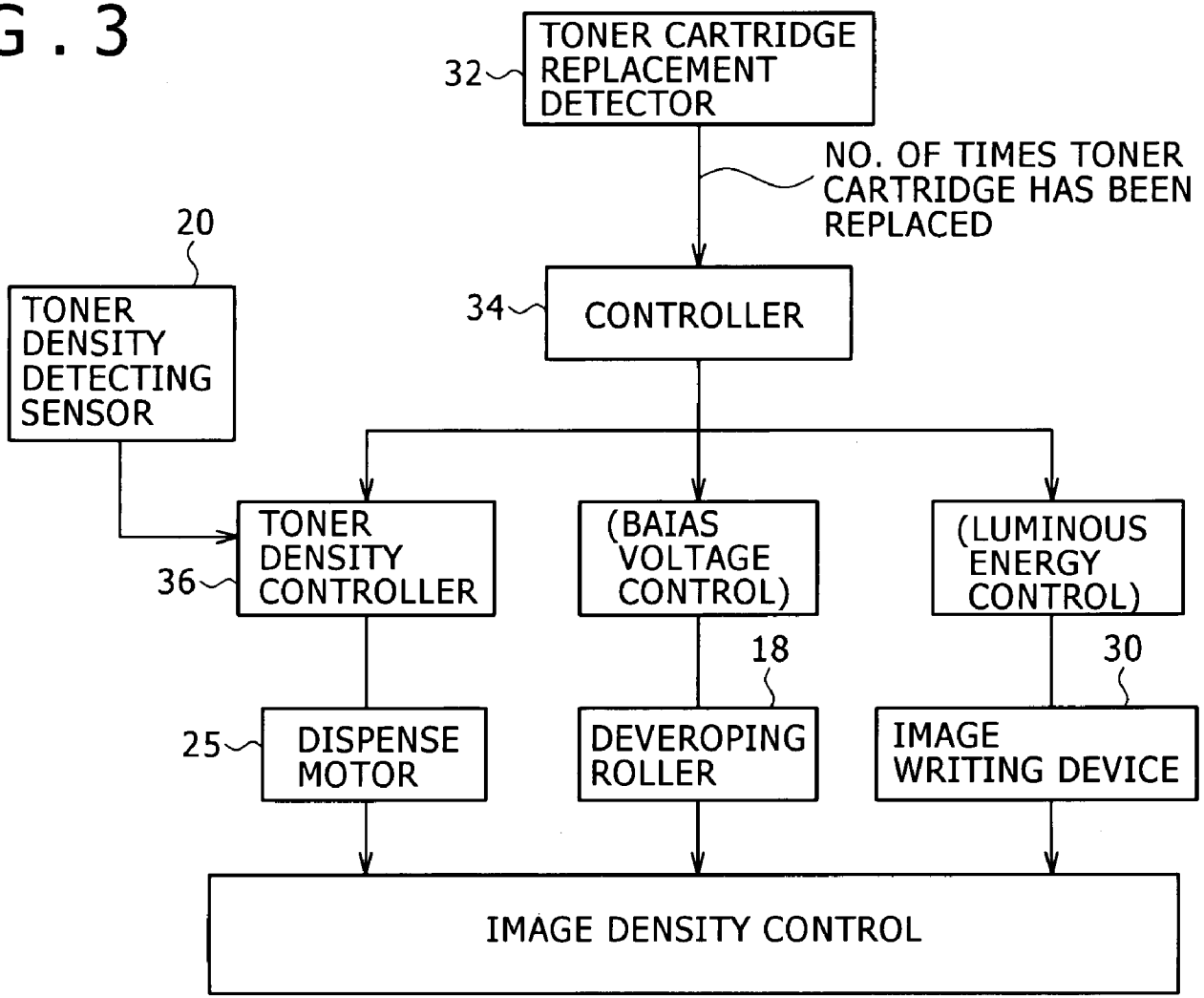
FIG. 3 shows the arrangement for the control of image density according to an embodiment of the present invention.

FIG. 3 shows the method of controlling the image density according to an embodiment of the present invention.

When untransferred residual toner collected at the step of cleaning the photosensitive drum is carried into the developing device 12 and reused as described above, which occurs every time the toner cartridge 24 is replaced in the same developing device 12, the residual toner and paper dust will affect the electric charge level and toner grain size distribution in the developer within the developing device 12. This may eventually invite problems of intensified fogging of the background due to the low charge of the developer and smearing of the machine inside by scattered toner.

To address this problem, in an embodiment, the toner cartridge replacement detector 32 detects the replacement of the toner cartridge 24 and, as shown in FIG. 3, stores the number of times the cartridge is replaced, and inputs the number to the controller 34. The controller 34 controls the image density according to the inputted number of times the toner cartridge 24 is replaced.

Thus, according to the inputted number of times the toner cartridge 24 is replaced, an altered control target value for the toner density detecting sensor is inputted to the toner density controller 36. The toner density controller 36 controls the operation of the dispense motor 25 according to the toner density of the developer detected by the toner density detecting sensor 20 and the altered toner density target value, and corrects the image density by correspondingly controlling the quantity of toner replenishment. Thus, by reducing the control target value of the toner density, and correspondingly the toner density, undesirable increases in image density are prevented.

In an alternative embodiment, the controller 34 adjusts the quantity of toner transferred to the electrostatic latent image on the photosensitive drum 26 and thereby corrects the image density by controlling the bias voltage applied to the developing roller 18 or the photosensitive drum 26 according to the inputted number of times the toner cartridge 24 is replaced. By reducing the quantity of toner used for developing the electrostatic latent image according to a potential difference from the photosensitive drum 26, the image density can be prevented from increasing in an undesirable manner.

In a further alternative embodiment, the controller 34 corrects the luminous energy of exposure according to the inputted number of times the toner cartridge 24 is replaced. Thus, the controller 34 controls the image signals inputted to the image writing device 30 and thereby corrects the image density. By reducing the overall density of image signals to a constant level or in accordance with a specific gamma, undesirable density rise due to the replacement of the toner cartridge 24 can be prevented or reduced.

By carrying out one or more of the exemplary ways of correcting the image density stated above, the image density can be corrected according to the number of times the toner cartridge 24 is replaced, and a rise in image density due to the replacement of the toner cartridge 24 can be restrained. Of course, the particular method of correcting image density is not important, provided that it is based on the number of times the toner cartridge 24 is replaced. Accordingly, any method of image density correction that is based on the number of times the toner cartridge is replaced is considered to be within the scope of the present invention.

<Control of Toner Density>

Figure 4A:
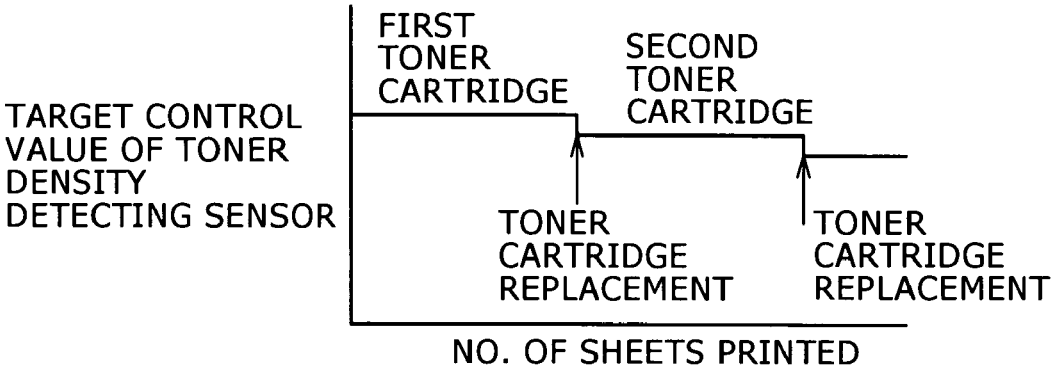
FIGS. 4A, 4B and 4C show cases of correction of a toner density according to an embodiment of the present invention.
Figure 4B:
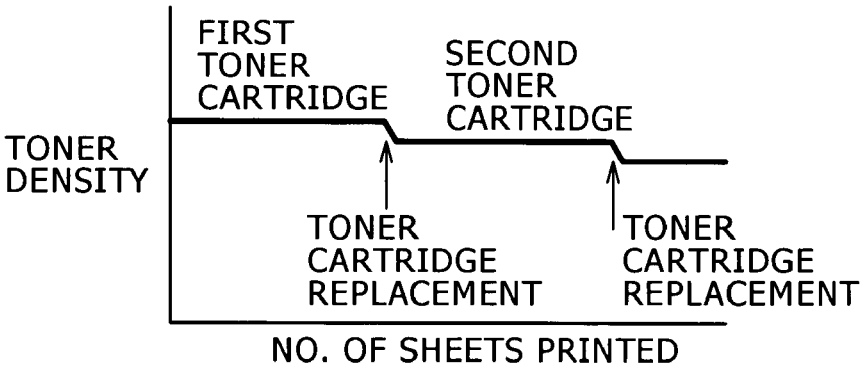
Figure 4C:
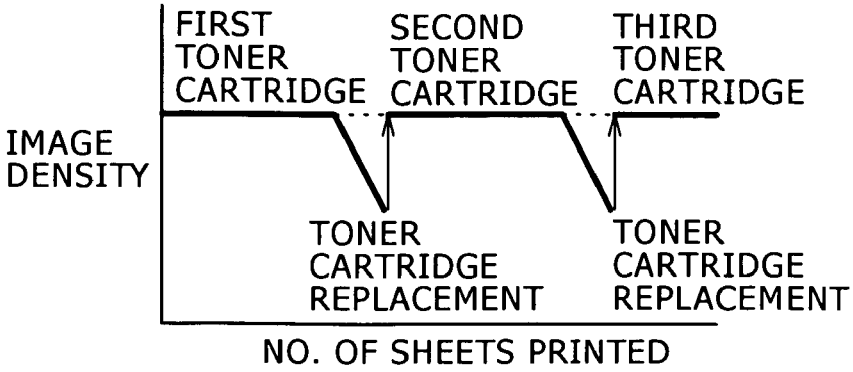
Figure 5A:
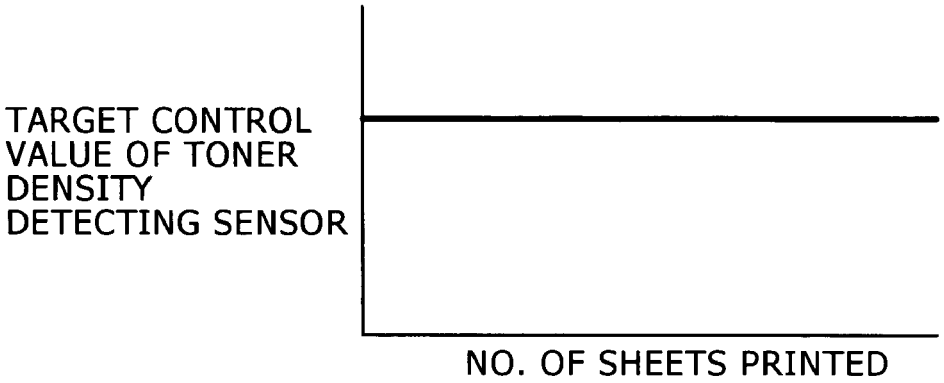
FIG. 5A RELATED ART
FIGS. 5A, 5B and 5C show fluctuations in toner density and image density according to the related art.
Figure 5B:
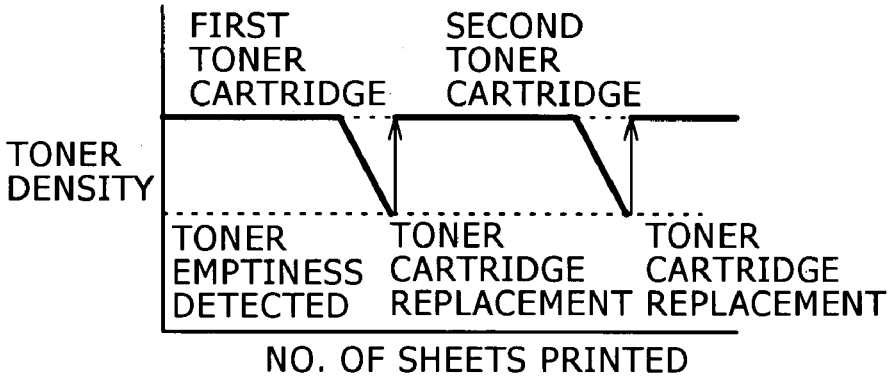
FIG. 5B RELATED ART
Figure 5C:
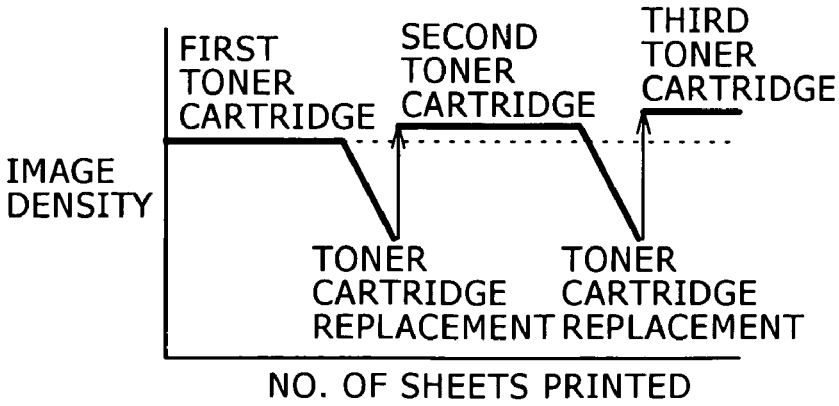
FIG. 5C RELATED ART

FIGS. 4A, 4B and 4C show examples of control of toner density according to an embodiment of the present invention.

With respect to an embodiment, correction of the image density according to the number of times the toner cartridge 24 is replaced will be described with reference to toner density control by the toner density controller 36 of FIG. 3, by way of example.

As stated above, the image density tends to rise according to the number of times the toner cartridge 24 is replaced. By storing the number of times of toner cartridge replacement and effecting control so as to reduce the image density accordingly, any rise in image density due to the replacement of the toner cartridge 24 can be eliminated or reduced.

More specifically, in an embodiment, the control target value of the toner density detecting sensor is altered (e.g., reduced) every time the toner cartridge 24 is replaced, as shown in FIG. 4A. Since the target control value of the toner density sensor is lower after the replacement of the toner cartridge 24 than before the replacement, the toner density is also controlled at a lower level as shown in FIG. 4B. Accordingly, a relative fall in the image density can set off the rise in image density due to the replacement of the toner cartridge 24. As a result, even though the toner cartridge 24 has been replaced, the image density will remain substantially unchanged.

The number of times the toner cartridge 24 is replaced can be stored, for example, either by the controller 34 or by the developing device 12 using a flash ROM or the like.

In an embodiment, the correction of the toner density and of the image density applies not only to the first replacement of the toner cartridge 24, but also to the second and subsequent replacements of the toner cartridge 24. In the second replacement of the toner cartridge 24, the target control value of the toner density detecting sensor should be set even lower than in the first density correction because the impact of the residual toner, paper dust and detection of toner cartridge emptiness are accumulated over their levels at the time of the first replacement of the toner cartridge 24. Thus, as shown in FIG. 4A, as the number of times the toner cartridge 24 is replaced increases, the target control value of the toner density detecting sensor should be set increasingly lower.

By reducing the toner density correspondingly each time the toner cartridge 24 is replaced as shown in FIG. 4B, the rise in image density due to the replacement of the toner cartridge 24 can be avoided.

As shown in FIG. 4C, by setting the target control value of the toner density detecting sensor increasingly lower according to the number of times the toner cartridge 24 is replaced as stated above, the image density can be kept substantially constant.

In an embodiment, if the developing device 12 is replaced with a new developing device 12, there is a risk that the image density may be erroneously modified based on the number of times the toner cartridge 24 was replaced in the old developing device 12.

This risk can be averted, for example, by having the number of replacements of both the toner cartridge 24 and the developing device 12 stored by the controller 34 on the image forming apparatus 10 side to manage the number of replacement of the toner cartridge 24 for each developing device 12. Alternatively, the stored number of replacement of the toner cartridge 24 my be reset to its initial value when the developing device 12 is replaced.

As described above, according to one aspect of the invention, there is provided an image forming apparatus including a developing device for developing an electrostatic latent image formed on an image carrier with a toner, and a toner cartridge for replenishing the developing device with the toner, wherein the toner on the image carrier is collected into the developing device for reuse, and an image density is adjusted according to the number of times of the toner cartridge replacement.

According to another aspect of the invention, the image forming apparatus includes a controller for adjusting the image density, wherein the developing device further includes a toner cartridge replacement detector that detects the number of times the toner cartridge has been replaced, and the image density is adjusted by inputting the number of times of the toner cartridge replacement detected by the toner cartridge replacement detector to the controller.

According to another aspect of the invention, in the image forming apparatus, the developing device further includes a carrier, and the developing device includes a toner density detecting sensor for detecting and controlling relative to the carrier within the developing device. The image density is adjusted by controlling a target value of the toner density of the toner density detecting sensor.

According to another aspect of the invention, in the image forming apparatus, the toner density detecting sensor detects the toner density by detecting a magnetic permeability of the toner and the magnetic permeability of the carrier within the developing device.

According to another aspect of the invention, in the image forming apparatus, the image density is adjusted by controlling a luminous energy applied for exposing the image carrier.

According to another aspect of the invention, in the image forming apparatus, the image carrier further includes an image writing device, and controlling the luminous energy is accomplished by controlling image signals inputted to the image writing device.

According to another aspect of the invention, in the image forming apparatus, the developing device further includes a developing roller, and the image density is adjusted by controlling a bias voltage applied to the developing roller or the image carrier.

According to another aspect of the invention, in the image forming apparatus, the image density is adjusted by controlling more than one of the toner density within the developing device detected by the toner density detecting sensor, the luminous energy applied for exposing the image carrier, and the bias voltage applied to the developing roller or the image carrier.

According to another aspect of the invention, in the image forming apparatus, the developing device further includes a memory for storing the number of times the toner cartridge has been replaced, the number being detected by the toner cartridge replacement detector.

According to another aspect of the invention, in the image forming apparatus, the number of times the toner cartridge is replaced, detected by the toner cartridge replacement detector, is stored in the controller, and the number of times the toner cartridge is replaced, stored in the controller, is initialized when the developing device is replaced.

The foregoing description of the embodiments of the present invention has been provided for the purposes of illustration and description. It is not intended to be exhaustive or to limit the invention to the precise forms disclosed. Many modifications and variations will be apparent to practitioners skilled in the art. The embodiments were chosen and described in order to explain the principles of the invention and its practical applications, thereby enabling others skilled in the art to understand the invention for various embodiments and with the various modifications as are suited to the particular use contemplated. It is intended that the scope of the invention be defined solely by the following claims and their equivalents.

The entire disclosure of Japanese Patent Application No. 2005-069863 filed on Mar. 11, 2005 including specification, claims, drawings and abstract is incorporated herein by reference in its entirety.

What is claimed is:

1. An image forming apparatus comprising:

a developing device that develops an electrostatic latent image formed on an image carrier with a toner, and a toner cartridge that replenishes the developing device with the toner, wherein excess toner on the image carrier is collected into the developing device for reuse, and an image density is adjusted according to the number of times the toner cartridge is replaced.

2. The image forming apparatus according to claim 1, comprising a controller that adjusts the image density, wherein the developing device further comprises a toner cartridge replacement detector that detects the number of times the toner cartridge is replaced, and the image density is adjusted by inputting the number of times of the toner cartridge replacement detected by the toner cartridge replacement detector to the controller.

3. The image forming apparatus according to claim 1, wherein the developing device further comprises a carrier, and the developing device comprises a toner density detecting sensor that detects and controls a toner density relative to the carrier within the developing device, and the image density is adjusted by controlling a target value of the toner density of the toner density detecting sensor.

4. The image forming apparatus according to claim 3, wherein the toner density detecting sensor detects the toner density by detecting a magnetic permeability of the toner and the magnetic permeability of the carrier within the developing device.

5. The image forming apparatus according to claim 1, wherein the image density is adjusted by controlling a luminous energy applied for exposure of the image carrier.

6. The image forming apparatus according to claim 5, wherein the image carrier further comprises an image writing device, and controlling the luminous energy is accomplished by controlling image signals inputted to the image writing device.

7. The image forming apparatus according to claim 1, wherein the developing device further comprises a developing roller, and the image density is adjusted by controlling a bias voltage applied to the developing roller or the image carrier.

8. The image forming apparatus according to claim 1, wherein the image density is adjusted by controlling more than one of the toner density within the developing device detected by the toner density detecting sensor, the luminous energy applied for the exposure of the image carrier, and the bias voltage applied to the developing roller or the image carrier.

9. The image forming apparatus according to claim 2, wherein the developing device further comprises a memory that stores the number of times the toner cartridge is replaced, the number being detected by the toner cartridge replacement detector.

10. The image forming apparatus according to claim 2, wherein the number of times the toner cartridge is replaced, detected by the toner cartridge replacement detector, is stored in the controller, and the number of times the toner cartridge is replaced, stored in the controller, is initialized when the developing device is replaced.

11. A method of controlling image density comprising:

providing a developing device that develops an electrostatic latent image formed on an image carrier with a toner;

sequentially providing plural toner cartridges that replenish the developing device with the toner;

collecting excess toner in the developing device for reuse; and adjusting an image density according to the number of times the toner cartridge is replaced.

12. The method of controlling image density according to claim 11, further comprising:

providing a controller that adjusts the image density;

providing a toner cartridge replacement detector that detects the number of times the toner cartridge is replaced; and adjusting the image density by inputting the number of times of the toner cartridge is replaced, as detected by the toner cartridge replacement detector, to the controller.

13. The method of controlling image density according to claim 11, wherein providing a developing device further comprises providing a carrier and a toner density detecting sensor that detects and controls a toner density relative to the carrier within the developing device; and further comprising:

adjusting the image density by controlling a target value of the toner density of the toner density detecting sensor.

14. The method of controlling image density according to claim 13, further comprising:

detecting toner density by detecting a magnetic permeability of the toner and the magnetic permeability of the carrier within the developing device.

15. The method of controlling image density according to claim 11, further comprising:

adjusting the image density by controlling a luminous energy applied for exposure of the image carrier.

16. The method of controlling image density according to claim 15, further comprising:

providing an image writing device; and controlling the luminous energy by controlling image signals inputted to the image writing device.

17. The method of controlling image density according to claim 11, wherein providing a developing device further comprises providing a developing roller; and further comprising:

adjusting the image density by controlling a bias voltage applied to the developing roller or the image carrier.

18. The method of controlling image density according to claim 11, wherein adjusting the image density further comprises controlling more than one of the toner density within the developing device detected by the toner density detecting sensor, the luminous energy applied for the exposure of the image carrier, and the bias voltage applied to the developing roller or the image carrier.

19. The method of controlling image density according to claim 12, further comprising providing a memory that stores the number of times the toner cartridge is replaced.

20. The method of controlling image density according to claim 12, further comprising:

storing the number of times the toner cartridge is replaced in the controller; and initializing the stored number when the developing device is replaced.

* * * * *